US006053183A

United States Patent [19]

Rizzo

[11] Patent Number: 6,053,183

[45] Date of Patent: Apr. 25, 2000

[54] LOOSE POWDER SIFTER

[75] Inventor: Peter S. Rizzo, Staten Island, N.Y.

[73] Assignee: Color Access, Inc., Melville, N.Y.

[21] Appl. No.: 09/247,710

[22] Filed: Feb. 9, 1999

[51] Int. Cl.[7] ..... A45D 33/02

[52] U.S. Cl. ..... 132/307

[58] Field of Search ..... 132/298, 299, 132/306, 307; 220/259; 222/480, 565

[56] References Cited

U.S. PATENT DOCUMENTS

| | | | |
|---|---|---|---|
| 208,145 | 9/1878 | Bell | 222/565 |
| 1,558,964 | 10/1925 | Clark | 132/306 |
| 1,715,169 | 5/1929 | McKee | 222/480 |
| 1,814,748 | 7/1931 | Friedman | 132/298 |
| 1,847,948 | 3/1932 | Kasdan | 132/299 |
| 1,903,357 | 4/1933 | Friedman | 132/298 |
| 2,043,726 | 6/1936 | Bangs | 132/306 |
| 2,753,051 | 7/1956 | Tupper | 220/259 |
| 3,016,168 | 1/1962 | Larson | 222/480 |
| 3,409,188 | 11/1968 | Wright | 222/480 |
| 5,139,181 | 8/1992 | VerWeyst | 220/259 |
| 5,183,171 | 2/1993 | Pherigo | 222/565 |
| 5,515,875 | 5/1996 | Acker et al. . | |

*Primary Examiner*—Todd E. Manahan
*Attorney, Agent, or Firm*—Kenyon & Kenyon

[57] ABSTRACT

A cosmetic powder container and insert which allows the consumer the option of either dispensing the powder through a sifter, or through an opening of sufficient diameter to accommodate a brush without the consumer having to remove and discard the insert itself. The insert generally comprises a base having an aperture, and a panel having a plurality of perforations. The panel is pivotally attached to the base by a hinge. The panel is capable of occupying a first open position and a second closed position. In the first open position, the panel is pivoted to a position where the aperture of the base is exposed and a brush can be used to apply the loose powder. In the second closed position, the panel covers the aperture and allows the sifter to be used to sprinkle the powder through the perforations.

31 Claims, 4 Drawing Sheets

LOOSE POWDER SIFTER

FIELD OF THE INVENTION

Generally, the present invention relates to containers for powdered or granulated cosmetic products. More particularly, the present invention relates to sifters for powdered or granulated cosmetic products. Still more particularly, the present invention provides an insert for powdered or granulated cosmetic product containers which insert provides a sifter for dispensing the product or an aperture sufficient for dispensing the product with a brush.

BACKGROUND OF THE INVENTION

Currently available loose powder containers include a housing portion which serves as a cup or reservoir for the loose powder. A perforated plate is disposed over the opening of the reservoir and then a top or cover is provided to enclose both the housing and the perforated plate. The perforated plate allows the consumer to sprinkle the powder from the reservoir onto their hands in controlled amounts. Once in their hands, the consumer can then apply the product to their face.

Certain customers, however, prefer to apply the loose powder to their face with a brush, therefore, loose powder containers are also typically sold with a brush. To provide a larger opening with which to facilitate easy application of the powder with a brush, the consumer often removes and discards the sifter from the loose powder container. When the consumer discards the sifter, the consumer can no longer dispense the powder from the container other than with a brush, thereby eliminating the option of controlled dispensing through a sifter.

Thus, an improved container for loose powder is needed. Preferably, the container should be provided with a means for controlled dispensing of the powder through a sifter as well as an opening sufficient in size for application of the powder with a brush.

The present invention provides an insert for loose powder containers which allows the consumer the option of either dispensing the powder through a perforated plate or sifter, or through an opening of sufficient diameter to accommodate a brush without the consumer having to remove and discard the insert itself.

SUMMARY OF THE INVENTION

The present invention provides a cosmetic powder container and insert which allows the consumer the option of either dispensing the powder through a sifter, or through an opening of sufficient diameter to accommodate a brush without the consumer having to remove and discard the insert itself.

The insert generally comprises a base having an aperture, and a panel having a plurality of perforations. The panel is pivotally attached to the base by a hinge. The panel is capable of occupying a first open position and a second closed position. In the first open position, the panel is pivoted to a position where the aperture of the base is exposed and a brush can be used to apply the loose powder. In the second closed position, the panel covers the aperture and allows the sifter to be used to sprinkle the powder through the perforations.

BRIEF DESCRIPTION OF THE INVENTION

Further objects, features and drawings of the present invention will better be understood in light of the embodiment examples which are discussed below with the aid of a drawing wherein.

DETAILED DESCRIPTION OF THE INVENTION

In general, the loose powder container contemplated for use with the insert of the present invention will be of a jar-type configuration, in that the container includes a compartment portion for a loose powder product which has a closed end and an open end. Within the open end is disposed the insert of the present invention, thereby positioning the loose powder product between the closed end of the compartment portion and the insert. Lastly, a closure is disposed about the open end of the container, thus sealing the open end of the container.

Figure 1:
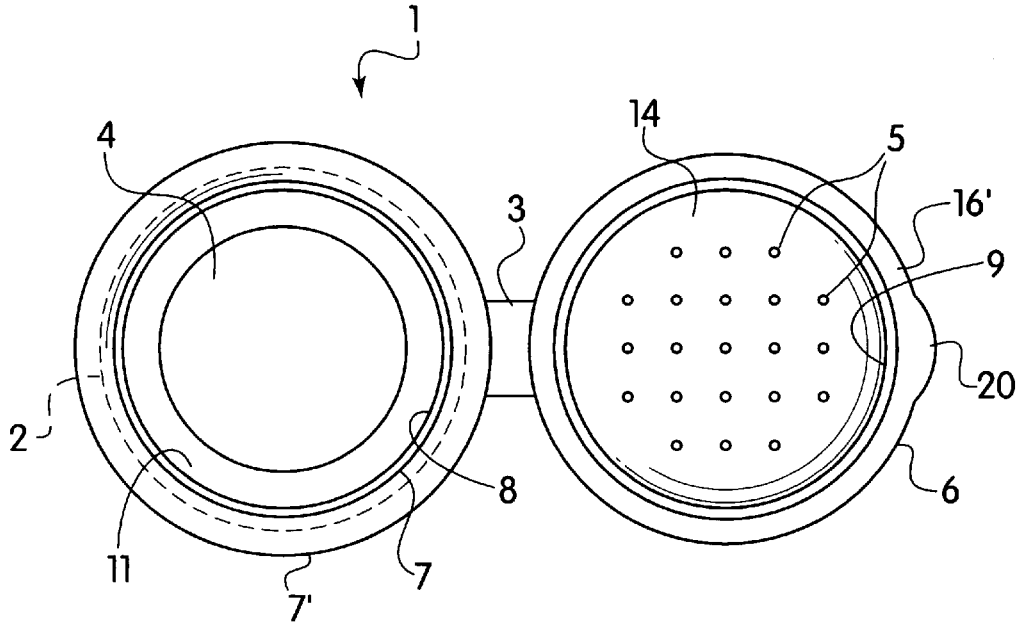
FIG. 1 is a top plan view of the insert of the present invention in the open position.
Figure 2:
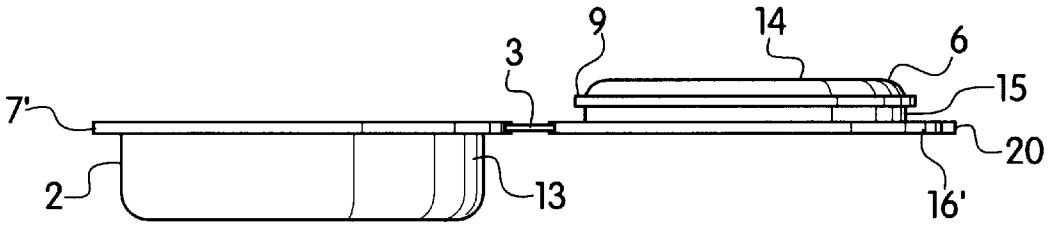
FIG. 2 is a side view of the insert of FIG. 1.
Figure 3:
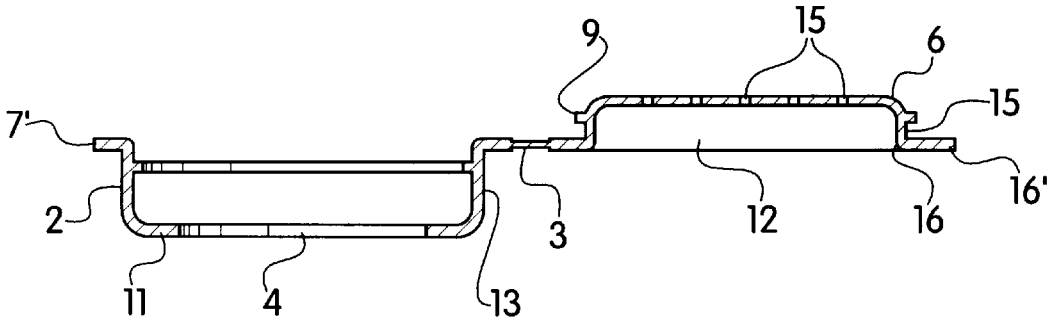
FIG. 3 is a side cross-sectional view of the insert of FIG. 1.

Referring now to the drawings, FIGS. 1 through 3 show one embodiment of the insert of the present invention, generally referred to as 1. The insert 1 comprises a base 2 having a bottom 11 with an aperture 4. A sidewall 13 connects the bottom 11 to an upper rim 7 which also features an outer flange 7'.

A panel 6 is attached to the base 2 by a hinge 3. The panel 6 comprises a platform 14 having a plurality of perforations 5. A wall 15 connects the platform 14 to a rim 16 which features a flange 16'. The flange 16' of the panel 6 is attached to the outer flange 7' of the base 2 by a hinge 3. The panel 6 pivots about the hinge 3 and is capable of occupying a first closed position and a second open position. In the first closed position, the panel 6 covers the aperture 4 of the base 2. In the second open position, the panel 6 is pivoted away from the base 2 to expose the aperture 4 of the base 2. Preferably, the panel 6 features a tab 20 to facilitate the opening and closing of the panel 6 over the base 2.

Preferably, the upper rim 7 of the base 2 has an inwardly extending bead 8 which provides a friction fit between the base 2 and the panel 6 when the panel 6 is in the closed position. Most preferably, the wall 15 of the panel 6, in addition to the base, is provided with a bead 9 for the purpose of enhancing the friction fit between the sidewall 13 of the base 2 and the wall of the panel 6 when the panel is in the closed position. Thus, referring to FIG. 4, when the panel 6 is pivoted downward into the closed position, the bead 9 of the panel 6 engages the bead 8 of the base 2 to hold the panel 6 in a closed position. The panel 6 is thereafter opened upon the application of a sufficient pressure in an upward direction against the tab 20.

Figure 4:
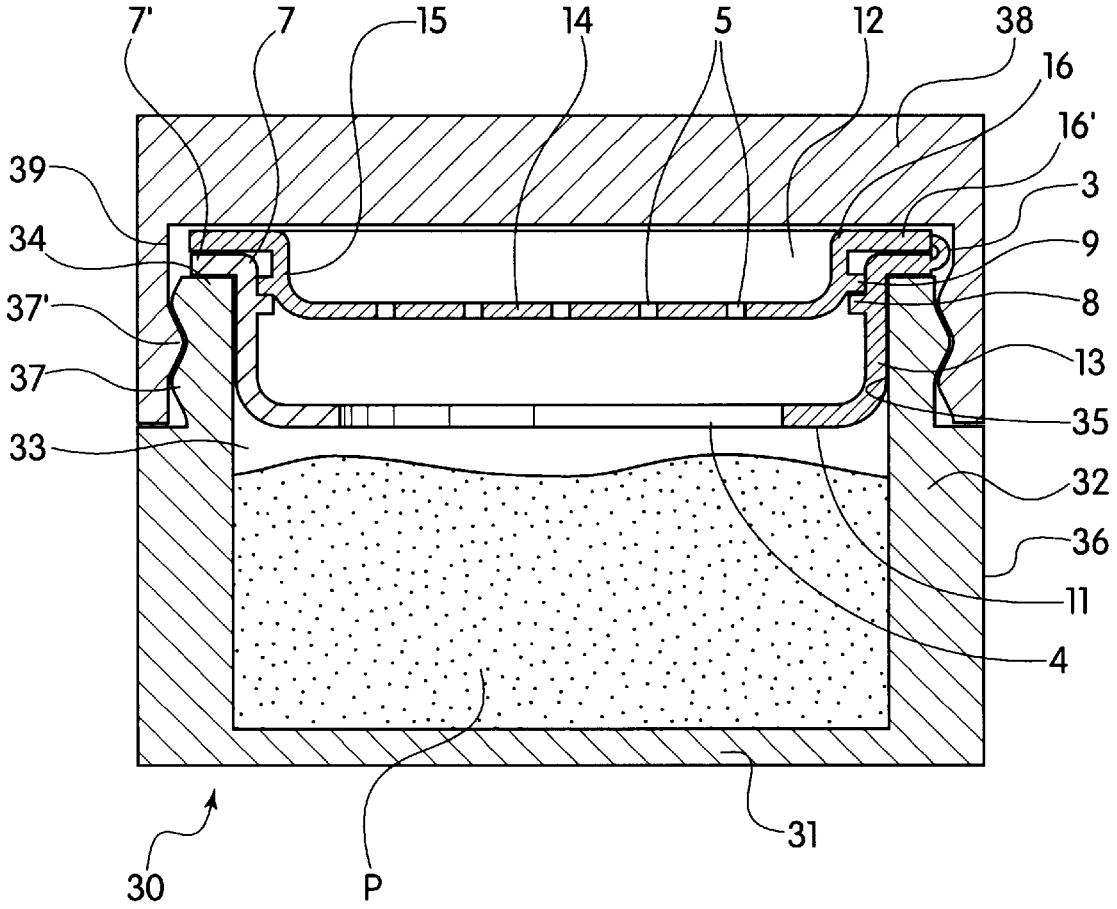
FIG. 4 is a side cross-sectional view of the loose powder container having an insert as shown in FIG. 1, the insert being in the closed position.

Preferably, as shown in FIG. 4, the insert 1 of the present invention is accommodated in a loose powder container 30.

The loose powder container 30 contemplated for use with the present invention is typically of a jar-type configuration, in that the container is provided with a bottom wall 31 and an upwardly projecting wall 32 which define a compartment 33 for the loose powder P. The upper edge 34 of the container wall 32 defines an opening within which the insert of the present invention is placed. The insert is held in place with a friction fit between the sidewall 13 of the base 2 and the inside surface 35 of the upwardly projecting wall 32. When the panel 6 of the insert is in the first closed position, as shown in FIG. 4, the platform 14 of the panel 6 completely covers the aperture 4 of the base 2, thus allowing the loose powder to only be dispensed through the plurality of perforations 5. When the panel 6 is pivoted into the second open position, the aperture 4 of the base 2 is exposed. With the aperture 4 exposed, the consumer can easily access the loose powder with a brush or similar applicator means. It will be readily apparent that the diameter of the aperture 4 can be varied to accommodate different sizes of brushes or applicators intended for use with the loose powder.

Additionally, the outside surface 36 of the container wall 32 is provided with a means for removably mounting a closure 38 on the container 30. Preferably, and as shown in FIG. 4, the means for removably mounting the closure 38 on the container 30 will consist of a set of opposing threads 37 and 37', one placed on the outside surface 36 of the container wall 32, and one placed on the inner surface 39 of the closure 38. Additional means for removably mounting a closure on a container are well known within the art and include lug fasteners, butterfly closures, snap-fit engagements, and the like.

Preferably, as shown in the embodiment depicted in FIGS. 1 through 4, the platform 14 and wall 15 of the panel 6 defines a recessed area 12. The recessed area 12 is provided to accommodate the applicator or brush or other applicator means during the transportation of the filled and assembled loose powder container. It is possible, however, to have the wall and platform not define a recessed area. For example, the platform and wall can have a solid cross-section instead of the recessed ross-section depicted in FIGS. 1 through 4.

In order to keep the loose powder from migrating through the aperture and perforations of the insert and contacting the applicator, the aperture of the base or the perforations of the panel may be covered by a removable label (not shown) which the consumer removes and discards before use.

FIGS. 5 through 8 show a further embodiment of the insert of the present invention. The insert, generally referred to as 50, comprises a base 60 having a bottom 61 with an aperture 62. A sidewall 63 connects the bottom 61 to an upper rim 64 which also features an outer flange 64'.

Figure 6B:
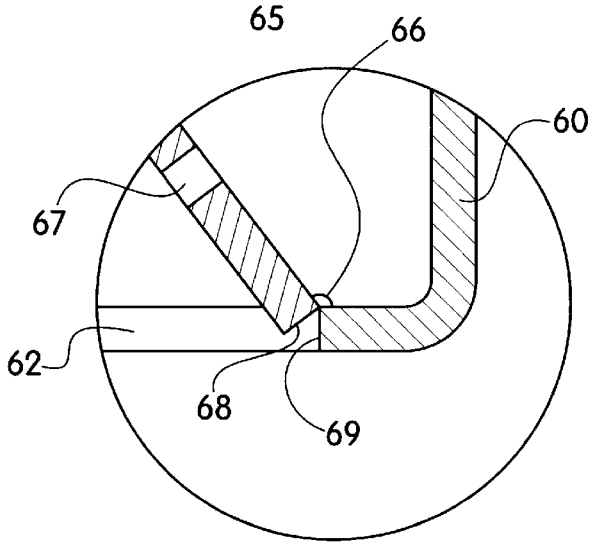
FIG. 6B is a magnified cross sectional view of detail B of FIG. 6.

A panel 65 is attached to the base 60 by a hinge 66. The panel 65 has a plurality of perforations 67. As seen more clearly in FIG. 6B, the outer edge 68 of the panel 65 is attached to the inner edge 69 of the aperture 62 by a hinge 66. The panel 65 pivots about the hinge 66 and is capable of occupying a first closed position and a second open position. In the first closed position, the panel 65 fits within the aperture 62 of the base 60 and thus allows the loose powder to be dispensed through the plurality of perforations 67 only. In the second open position, the panel 65 is pivoted away from the base 60 to expose the aperture 62 and facilitate the application of the loose powder with a brush or other applicator means. Preferably, the panel 65 features a tab 70 to facilitate the opening and closing of the panel within the aperture.

Figure 5:
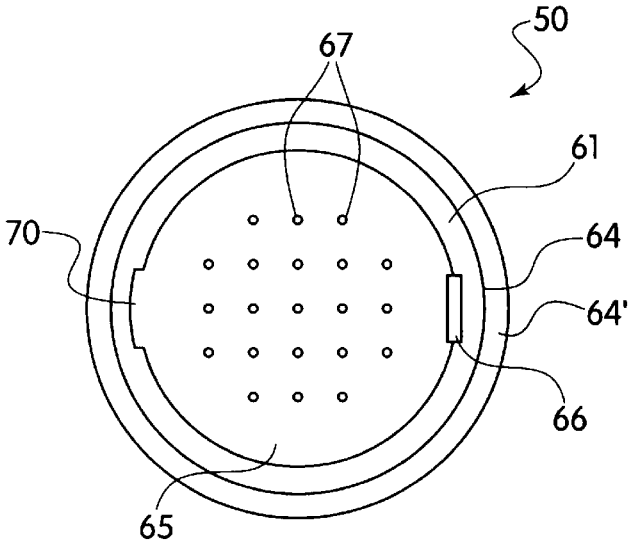
FIG. 5 is a top plan view of a second embodiment of the insert of the present invention in the closed position.
Figure 6:
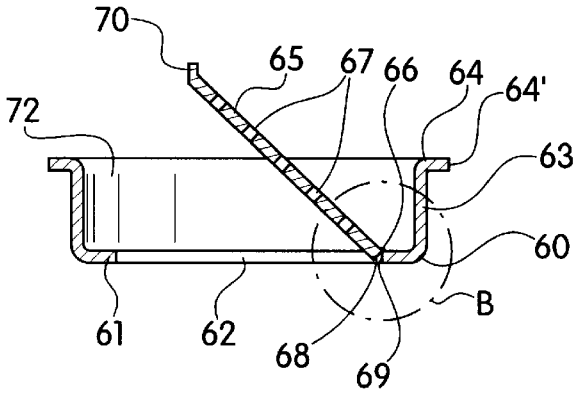
FIG. 6 is a side cross-sectional view of the insert of FIG. 5 in the open position.

As seen with the embodiments of FIGS. 5 through 8, the aperture 62 of the base 60 can assume a variety of shapes. For example, as seen in FIGS. 5 and 6, the aperture 62 is substantially circular, and the panel 65 is of a complementary shape and sized to fit within the aperture so that, in the closed position, the panel 65 engages the perimeter of the aperture 62.

Figure 7:
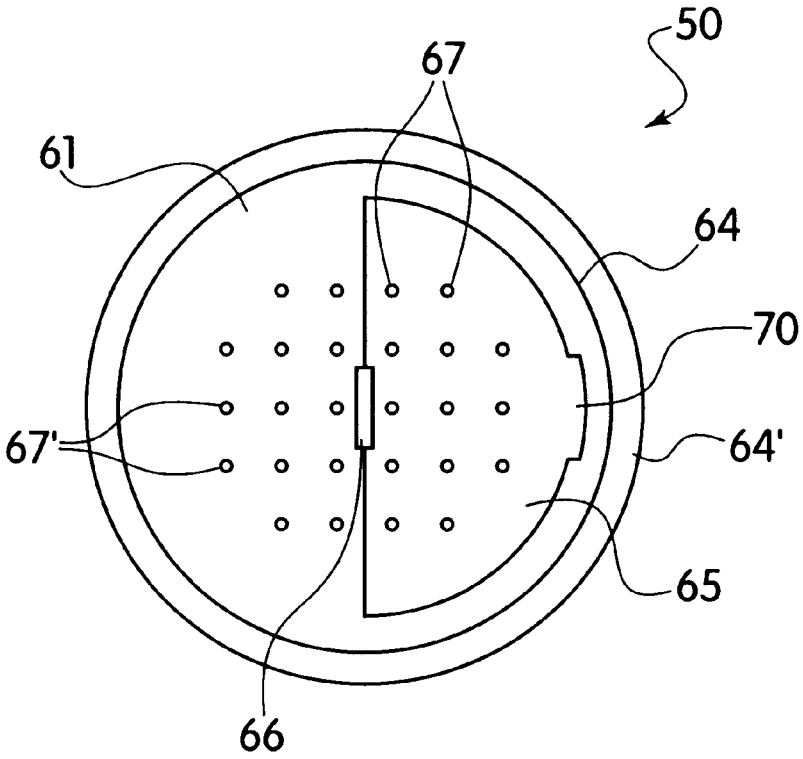
FIG. 7 is a top plan view of a further embodiment of the insert of the present invention in the closed position.
Figure 8:
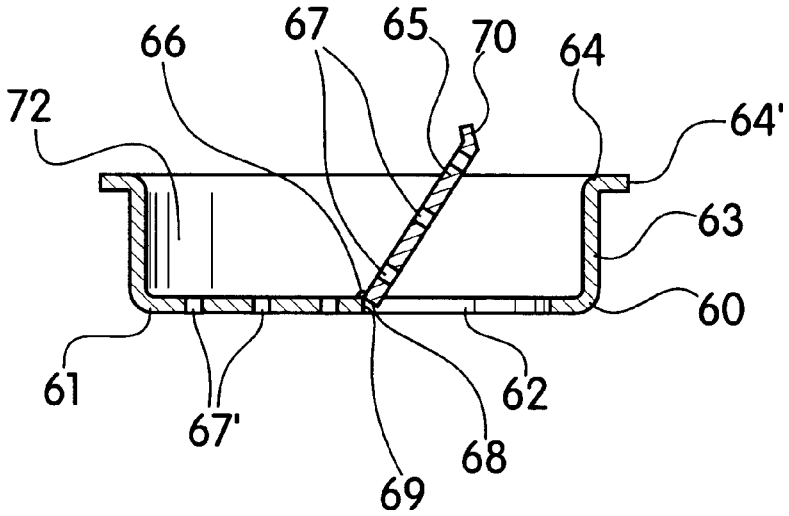
FIG. 8 is a side cross-sectional view of the insert of FIG. 7 in the open position.

Also, the shape of the aperture can be other than circular, as seen for example in FIGS. 7 and 8, wherein the aperture 62 is half-moon shaped. In this configuration, the bottom 61 of the base 60 has a plurality of perforations 67' and an aperture 62. The perforations 67' on the bottom 61 are provided so that the insert 50 can operate as a sifter when the panel 65 is in the closed position.

It will be readily apparent to one of skill in the art that the aperture can assume many shapes and sizes, those shapes and sizes being chosen on aesthetic considerations as well as what will be required for the applicator of choice to easily pass through the aperture and access the powder below. With reference to the embodiments of FIGS. 5 through 8, the panel is preferably of a complementary shape and sized to fit within the aperture so that, in the closed position, the panel engages the perimeter of the aperture, thus allowing the loose powder to be dispensed through the plurality of perforations and not the aperture. As previously described above, the insert is accommodated in a loose powder container, typically of a jar-type configuration.

As seen in FIGS. 5 through 8, the bottom 61, sidewall 63 and panel 65 defines a recessed area 72. The recessed area 72 is provided to accommodate the applicator or brush or other applicator means during the transportation of the filled and assembled loose powder container. In order to keep the loose powder from migrating through the perforations of the insert and contacting the applicator, the perforations may be covered by a removable label (not shown) which the consumer removes and discards before use.

Although only certain embodiments of the present invention have been illustrated, it will at once be apparent to those skilled in the art that variations may be made within the scope of the invention. Accordingly, it is intended that the scope of the present invention be limited solely by the wording of the hereafter appended claims, and not by any specific wording in the foregoing description.

What is claimed is:

1. An insert for a cosmetic powder container, said insert comprising:

a base having a bottom horizontal wall and a sidewall extending upwardly from the bottom horizontal wall and terminating at an upper rim, said bottom horizontal wall having an aperture adapted to receive at least an application portion of an applicator;

a panel having a plurality of perforations, said panel connected to the base by a hinge and capable of occupying a first closed position and a second open position; and a recessed area adapted to store the applicator, the recessed area defined in the insert by at least one of the base or the panel.

2. The insert of claim 1 wherein an outer flange extends radially from the upper rim.

3. The insert of claim 2 wherein the panel comprises a platform having the plurality of perforations, a wall which extends upwardly from the platform and terminates at a rim, and a flange extending radially from the rim.

4. The insert of claim 3 wherein the outer flange of the base is connected to the flange of the panel by the hinge.

5. The insert of claim 3 wherein the sidewall of the base includes an inner surface and an outer surface, the wall of the panel includes an interior surface and an exterior surface, said exterior surface of the panel and inner surface of the base mateably engaging each other when the panel is in the closed position.

6. The insert of claim 5 wherein the upper rim of the base is provided with an inwardly extending bead which provides a friction fit between the base and the panel when the panel is in the closed position.

7. The insert of claim 6 wherein the exterior surface of the panel is provided with a bead which provides a friction fit between the base and the panel when the panel is in the closed position.

8. The insert of claim 1 wherein the panel has a tab to facilitate the moving of the panel from the first closed position to the second open position.

9. The insert of claim 1 wherein the panel is of a complementary shape to the aperture.

10. The insert of claim 9 wherein the panel includes an outer edge, and the aperture includes an inner edge, said outer edge and inner edge connected by the hinge.

11. The insert of claim 10 wherein the outer edge of the panel mateably engages the inner edge of the aperture when the panel is in the closed position.

12. A package for a loose powder product, said package comprising:

a loose powder container, said container having a bottom wall and an upwardly projecting wall which define a product compartment, said upwardly projecting wall terminating at an upper edge which defines an opening;

an insert fitted within the opening of the container, said insert comprising:

a base having a bottom horizontal wall and a sidewall extending upwardly from the bottom horizontal wall and terminating at an upper rim, said bottom horizontal wall having an aperture adapted to receive at least an application portion of an applicator;

a panel having a plurality of perforations, said panel connected to the base by a hinge and capable of occupying a first closed position and a second open position; and a recessed area adapted to store the applicator, the recessed area defined in the insert by at least one of the base or the panel.

13. The package of claim 12 wherein an outer flange extends radially from the upper rim.

14. The package of claim 13 wherein the panel comprises a platform having the plurality of perforations, a wall which extends upwardly from the platform and terminates at a rim, and a flange extending radially from the rim.

15. The package of claim 14 wherein the outer flange of the base is connected to the flange of the panel by the hinge.

16. The package of claim 14 wherein the sidewall of the base includes an inner surface and an outer surface, the wall of the panel includes an interior surface and an exterior surface, said exterior surface of the panel and inner surface of the base mateably engaging each other when the panel is in the closed position.

17. The package of claim 16 wherein the upper rim of the base is provided with an inwardly extending bead which provides a friction fit between the base and the panel when the panel is in the closed position.

18. The package of claim 17 wherein the exterior surface of the panel is provided With a bead which provides a friction fit between the base and the panel when the panel is in the closed position.

19. The package of claim 12 wherein the panel has a tab to facilitate the moving of the panel from the first closed position to the second open position.

20. The package of claim 12 wherein the panel is of complementary shape to the aperture.

21. The package of claim 20 wherein the panel includes an outer edge, and the aperture includes an inner edge, said outer edge and inner edge connected by the hinge.

22. The package of claim 21 wherein the outer edge of the panel mateably engages the inner edge of the aperture when the panel is in the closed position.

23. An insert for a cosmetic powder container, said insert comprising:

a base having a bottom horizontal wall, a sidewall extending upwardly from the bottom horizontal wall and terminating at an upper rim, and an outer flange extending radially from the upper rim, said bottom horizontal wall having an aperture adapted to receive at least an application portion of an applicator;

a panel connected to the base by a hinge and capable of occupying a first closed position and a second open position, said panel comprising a platform having a plurality of perforations, a wall which extends upwardly from the platform and terminates at a rim, and a flange extending radially from the rim; and a recessed area adapted to store the applicator, the recessed area defined in the insert by at least one of the base or the panel.

24. The insert of claim 23 wherein the outer flange of the base is connected to the flange of the panel by the hinge.

25. The insert of claim 23 wherein the panel has a tab to facilitate the moving of the panel from the first closed position to the second open position.

26. The insert of claim 23 wherein the sidewall of the base includes an inner surface and an outer surface, the wall of the panel includes an interior surface and an exterior surface, said exterior surface of the panel and inner surface of the base mateably engaging each other when the panel is in the closed position.

27. The insert of claim 26 wherein the upper rim of the base is provided with an inwardly extending bead which provides a friction fit between the base and the panel when the panel is in the closed position.

28. The insert of claim 27 wherein the exterior surface of the panel is provided with a bead which provides a friction fit between the base and the panel when the panel is in the closed position.

29. An insert for a cosmetic powder container, said insert comprising:

a base having a bottom horizontal wall and a sidewall extending upwardly from the bottom horizontal wall and terminating at an upper rim, said bottom horizontal wall having an aperture with an inner edge, the aperture adapted to receive at least an application portion of an applicator;

a panel having an outer edge and a plurality of perforations, said panel capable of occupying a first closed position and a second open position, and said outer edge connected to the inner edge of the aperture by a hinge; and a recessed area above the panel adapted to store the applicator, the recessed area defined in the insert by at least one of the base or the panel.

30. The insert of claim 29 wherein the panel is of a complementary shape to the aperture.

31. The insert of claim 29 wherein the outer edge of the panel mateably engages the inner edge of the aperture when the panel is in the closed position.

* * * * *